US008050933B2

(12) United States Patent
Davidson et al.

(10) Patent No.: US 8,050,933 B2
(45) **Date of Patent: *Nov. 1, 2011**

(54) AUDIO CODING SYSTEM USING TEMPORAL SHAPE OF A DECODED SIGNAL TO ADAPT SYNTHESIZED SPECTRAL COMPONENTS

(75) Inventors: Grant Allen Davidson, Burlingame, CA (US); Michael Mead Truman, Missouri City, TX (US); Matthew Conrad Fellers, San Francisco, CA (US); Mark Stuart Vinton, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 205 days.

This patent is subject to a terminal disclaimer.

(21) Appl. No.: 12/365,783

(22) Filed: Feb. 4, 2009

(65) Prior Publication Data

US 2009/0144055 A1 Jun. 4, 2009

Related U.S. Application Data

(63) Continuation of application No. 11/881,674, filed on Jul. 27, 2007, now abandoned, which is a continuation of application No. 10/238,047, filed on Sep. 6, 2002, now Pat. No. 7,337,118, which is a continuation-in-part of application No. 10/174,493, filed on Jun. 17, 2002, now Pat. No. 7,447,631.

(51) Int. Cl.
*G10L 19/02* (2006.01)

(52) U.S. Cl. ..... 704/501; 704/500

(58) Field of Classification Search ..... 704/500, 704/501

See application file for complete search history.

(56) References Cited

U.S. PATENT DOCUMENTS

| | | | |
|---|---|---|---|
| 3,684,838 | A | 8/1972 | Kahn |
| 3,995,115 | A | 11/1976 | Kelly |
| 4,610,022 | A | 9/1986 | Kitayama et al. |
| 4,667,340 | A | 5/1987 | Arjmand et al. |
| 4,757,517 | A | 7/1988 | Yatsuzuka |
| 4,776,014 | A | 10/1988 | Zinser, Jr. |
| 4,790,016 | A | 12/1988 | Mazor et al. |
| 4,885,790 | A | 12/1989 | McAulay et al. |
| 4,914,701 | A | 4/1990 | Zibman |
| 4,935,963 | A | 6/1990 | Jain |
| 5,001,758 | A | 3/1991 | Galand et al. |
| 5,054,072 | A | 10/1991 | McAulay et al. |
| 5,054,075 | A | 10/1991 | Hong et al. |
| 5,109,417 | A | 4/1992 | Fielder et al. |
| 5,127,054 | A | 6/1992 | Hong et al. |

(Continued)

FOREIGN PATENT DOCUMENTS

| | | |
|---|---|---|
| DE | 195 09 149 | 9/1996 |

(Continued)

OTHER PUBLICATIONS

No further pertinent prior art was found.*

(Continued)

*Primary Examiner* — Talivaldis Ivars Smits

(57) ABSTRACT

A receiver in an audio coding system receives a signal conveying frequency subband signals representing an audio signal. The subband signals are examined to assess one or more characteristics of the audio signal including temporal shape. Spectral components are synthesized having the one or more assessed characteristics, integrated with the subband signals and passed through a synthesis filterbank to generate an output signal.

9 Claims, 2 Drawing Sheets

U.S. PATENT DOCUMENTS

| | | | |
|---|---|---|---|
| 5,264,846 | A | 11/1993 | Oikawa |
| 5,381,143 | A | 1/1995 | Shimoyoshi et al. |
| 5,394,473 | A | 2/1995 | Davidson |
| 5,402,124 | A | 3/1995 | Todd et al. |
| 5,461,378 | A | 10/1995 | Shimoyoshi et al. |
| 5,583,962 | A | 12/1996 | Davis et al. |
| 5,623,577 | A | 4/1997 | Fielder |
| 5,636,324 | A | 6/1997 | Teh |
| 5,692,102 | A | 11/1997 | Pan |
| 5,758,020 | A | 5/1998 | Tsutsui |
| 5,758,315 | A | 5/1998 | Mori |
| 5,842,160 | A | 11/1998 | Zinser |
| 5,924,064 | A | 7/1999 | Helf |
| RE36,478 | E | 12/1999 | McAulay et al. |
| 6,014,621 | A | 1/2000 | Chen |
| 6,058,362 | A | 5/2000 | Malvar |
| 6,092,041 | A | 7/2000 | Pan et al. |
| 6,115,689 | A | 9/2000 | Malvar |
| 6,138,051 | A | 10/2000 | Dieterich |
| 6,222,941 | B1 | 4/2001 | Zandi et al. |
| 6,300,888 | B1 | 10/2001 | Chen et al. |
| 6,341,165 | B1 | 1/2002 | Brandenburg et al. |
| 6,351,730 | B2 | 2/2002 | Chen |
| 6,424,939 | B1 | 7/2002 | Herre et al. |
| 6,675,144 | B1 | 1/2004 | Tucker |
| 6,708,145 | B1 | 3/2004 | Liljeryd et al. |
| 2002/0009142 | A1 | 1/2002 | Aono et al. |
| 2003/0093282 | A1 | 5/2003 | Goodwin |
| 2004/0114687 | A1 | 6/2004 | Ferris et al. |
| 2004/0131203 | A1 | 7/2004 | Liljeryd et al. |

FOREIGN PATENT DOCUMENTS

| | | |
|---|---|---|
| EP | 0 746 116 | 12/1996 |
| JP | 06-075595 | 3/1994 |
| JP | 07-225598 | 8/1995 |
| JP | 08-223052 | 8/1996 |
| JP | 2001521648 | 11/2001 |
| JP | 2001356788 | 12/2001 |
| WO | WO 98/57436 | 12/1998 |
| WO | WO 00/45379 | 8/2000 |
| WO | WO 01/91111 | 11/2001 |
| WO | WO 02/41302 | 5/2002 |

OTHER PUBLICATIONS

Atkinson et al.; "Time Envelope LP Vocoder: A New Coding Technique at Very Low Bit Rates," 4th European Conference on Speech Communication and Technology, ESCA Eurospeech 95, Madrid, Sep. 1995, ISSN 1018-4074, pp. 241-244.

Bosi, et al., "ISO/IEC MPEG-2 Advanced Audio Coding," Journal of Audio Engineering Society, vol. 45, No. 10, Oct. 1997, pp. 789-814.

Edler; "Codierung von Audiosignalen mit uberlappender Transformation und Adaptivene Fensterfunktionen," Frequenz, 1989, vol. 43, pp. 252-256.

Ehret et al.; "Technical Description of Coding Technologies' Proposal for MPEG-4 v3 General Audio Bandwidth Extension: Spectral Band Replication (SBR)", Coding Technologies AB/GmbH, Mar. 2002.

Galand et al.; "High-Frequency Regeneration of Base-Band Vocoders by Multi-Pulse Excitation," IEEE International Conference on Speech and Signal Processing, Apr. 1987, pp. 1934-1937.

Grauel; "Sub-Band Coding with Adaptive Bit Allocation, Signal Processing", vol. 2, No. 1, Jan. 1980, North Holland Publishing Co., ISSN 0 165-1684, pp. 23-30.

Hans et al.; "An MPEG Audio Layered Transcoder" preprint of paper presented at 105th AES Convention, Sep. 1998, pp. 1-18.

Herre et al.; "Enhancing the Performance of Perceptual Audio Coders by Using Temporal Noise Shaping (TNS)," 101st AES Convention, Nov. 1996, preprint 4384.

Herre et al.; "Exploiting Both Time and Frequency Structure in a System That Uses an Analysis/Synthesis Filterbank with High Frequency Resolution," 103rd AES Convention, Sep. 1997, preprint 4519.

Herre et al.; "Extending the MPEG-4 AAC Codec by Perceptual Noise Substitution," 104th AES Convention, May 1998, preprint 4720.

Laroche et al.; "New phase-Vocoder Techniques for Pitch-Shifting, Harmonizing and Other Exotic Effects," Proceeding IEEE Workshop on Applications of Signal Processing to Audio and Acoustics, New Paltz, New York, Oct. 1999, pp. 91-94.

Liu et al.; "Design of the Coupling Schemes for the Dolby AC-3 Coder in Stereo Coding", International Conference on Consumer Electronics, ICCE, Jun. 2, 1998, IEEE XP010283089; pp. 328-329.

Makhoul et al.; "High-Frequency Regeneration in Speech Coding Systems," IEEE International Conference on Speech and Signal Processing, Apr. 1979, pp. 428-431.

Nakajima et al.; "MPEG Audio Bit Rate Scaling on Coded Data Domain" Acoustics, Speech and Signal Processing, 1998, Proceedings of 1998 IEEE International Conference on Speech and Signal Processing, Seattle, Washington, May 12-15, 1998, New York IEEE pp. 3669-3672.

Rabiner et al.; "Digital Processing of Speech Signals," Prentice-Hall, 1978, pp. 396-404.

Stott; "DRM—key technical features," EBU Technical Review, Mar. 2001, pp. 1-24.

Sugiyama et. al.; "Adaptive Transform Coding With an Adaptive Block Size (ATC-ABS)", IEEE International Conference on Acoustics, Speech, and Signal Procressing, Apr. 1990.

Zinser; "An Efficient, Pitch-Aligned High-Frequency Regeneration Technique for RELP Vocoders," IEEE International Conference on Speech and Signal Processsing, Mar. 1985, p. 969-972.

ATSC Standard: Digital Audio Compression (AC-3), Revision A, Aug. 20, 2001, Sections 1-4, 6, 7.3 and 8.

Office Action mailed Oct. 18, 2007 for U.S. Appl. No. 10/113,858, filed Mar. 28, 2002.

Office Action mailed Oct. 1, 2007 for U.S. Appl. No. 10/174,493, filed Jun. 17, 2002.

* cited by examiner

AUDIO CODING SYSTEM USING TEMPORAL SHAPE OF A DECODED SIGNAL TO ADAPT SYNTHESIZED SPECTRAL COMPONENTS

TECHNICAL FIELD

The present invention is related generally to audio coding systems, and is related more specifically to improving the perceived quality of the audio signals obtained from audio coding systems.

BACKGROUND ART

Audio coding systems are used to encode an audio signal into an encoded signal that is suitable for transmission or storage, and then subsequently receive or retrieve the encoded signal and decode it to obtain a version of the original audio signal for playback. Perceptual audio coding systems attempt to encode an audio signal into an encoded signal that has lower information capacity requirements than the original audio signal, and then subsequently decode the encoded signal to provide an output that is perceptually indistinguishable from the original audio signal. One example of a perceptual audio coding system is described in the Advanced Television Systems Committee (ATSC) A/52A document entitled "Revision A to Digital Audio Compression (AC-3) Standard" published Aug. 20, 2001, which is referred to as Dolby Digital. Another example is described in Bosi et al., "ISO/IEC MPEG-2 Advanced Audio Coding." J. AES, vol. 45, no. 10, October 1997, pp. 789-814, which is referred to as Advanced Audio Coding (AAC). In these two coding systems, as well as in many other perceptual coding systems, a split-band transmitter applies an analysis filterbank to an audio signal to obtain spectral components that are arranged in groups or frequency bands, and encodes the spectral components according to psychoacoustic principles to generate an encoded signal. The band widths typically vary and are usually commensurate with widths of the so called critical bands of the human auditory system. A complementary split-band receiver receives decodes the encoded signal to recover spectral components and applies a synthesis filterbank to the decoded spectral components to obtain a replica of the original audio signal.

Perceptual coding systems can be used to reduce the information capacity requirements of an audio signal while preserving a subjective or perceived measure of audio quality so that an encoded representation of the audio signal can be conveyed through a communication channel using less bandwidth or stored on a recording medium using less space. Information capacity requirements are reduced by quantizing the spectral components. Quantization injects noise into the quantized signal, but perceptual audio coding systems generally use psychoacoustic models in an attempt to control the amplitude of quantization noise so that it is masked or rendered inaudible by spectral components in the signal.

Traditional perceptual coding techniques work reasonably well in audio coding systems that are allowed to transmit or record encoded signals having medium to high bit rates, but these techniques by themselves do not provide very good audio quality when the encoded signals are constrained to low bit rates. Other techniques have been used in conjunction with perceptual coding techniques in an attempt to provide high quality signals at very low bit rates.

One technique called "High-Frequency Regeneration" (HFR) is described in U.S. patent application publication number 2003-0187,663 A1, entitled "Broadband Frequency Translation for High Frequency Regeneration" by Truman, et al., published Oct. 2, 2003, which is incorporated herein by reference in its entirety. In an audio coding system that uses HFR, a transmitter excludes high-frequency components from the encoded signal and a receiver regenerates or synthesizes noise-like substitute components for the missing high-frequency components. The resulting signal provided at the output of the receiver generally is not perceptually identical to the original signal provided at the input to the transmitter but sophisticated regeneration techniques can provide an output signal that is a fairly good approximation of the original input signal having a much higher perceived quality that would otherwise be possible at low bit rates. In this context, high quality usually means a wide bandwidth and a low level of perceived noise.

Another synthesis technique called "Spectral Hole Filling" (SHF) is described in U.S. patent application publication number 2003-0233234 A1 entitled "Improved Audio Coding System Using Spectral Hole Filling" by Truman, et al., published Dec. 18, 2003, which is incorporated herein by reference in its entirety. According to this technique, a transmitter quantizes and encodes spectral components of an input signal in such a manner that bands of spectral components are omitted from the encoded signal. The bands of missing spectral components are referred to as spectral holes. A receiver synthesizes spectral components to fill the spectral holes. The SHF technique generally does not provide an output signal that is perceptually identical to the original input signal but it can improve the perceived quality of the output signal in systems that are constrained to operate with low bit rate encoded signals.

Techniques like HFR and SHF can provide an advantage in many situations but they do not work well in all situations. One situation that is particularly troublesome arises when an audio signal having a rapidly changing amplitude is encoded by a system that uses block transforms to implement the analysis and synthesis filterbanks. In this situation, audible noise-like components can be smeared across a period of time that corresponds to a transform block.

One technique that can be used to reduce the audible effects of time-smeared noise is to decrease the block length of the analysis and synthesis transforms for intervals of the input signal that are highly non-stationary. This technique works well in audio coding systems that are allowed to transmit or record encoded signals having medium to high bit rates, but it does not work as well in lower bit rate systems because the use of shorter blocks reduces the coding gain achieved by the transform.

In another technique, a transmitter modifies the input signal so that rapid changes in amplitude are removed or reduced prior to application of the analysis transform. The receiver reverses the effects of the modifications after application of the synthesis transform. Unfortunately, this technique obscures the true spectral characteristics of the input signal, thereby distorting information needed for effective perceptual coding, and because the transmitter must use part of the transmitted signal to convey parameters that the receiver needs to reverse the effects of the modifications.

In a third technique known as temporal noise shaping, a transmitter applies a prediction filter to the spectral components obtained from the analysis filterbank, conveys prediction errors and the predictive filter coefficients in the transmitted signal, and the receiver applies an inverse prediction filter to the prediction errors to recover the spectral components. This technique is undesirable in low bit rate systems because of the signal overhead needed to convey the predictive filter coefficients.

DISCLOSURE OF INVENTION

It is an object of the present invention to provide techniques that can be used in low bit rate audio coding systems to improve the perceived quality of the audio signals generated by such systems.

According to the present invention, encoded audio information is processed by receiving the encoded audio information and obtaining subband signals representing some but not all spectral content of an audio signal, examining the subband signals to obtain a characteristic of the audio signal, generating synthesized spectral components that have the characteristic of the audio signal, integrating the synthesized spectral components with the subband signals to generate a set of modified subband signals, and generating the audio information by applying a synthesis filterbank to the set of modified subband signals.

The various features of the present invention and its preferred embodiments may be better understood by referring to the following discussion and the accompanying drawings. The contents of the following discussion and the drawings are set forth as examples only and should not be understood to represent limitations upon the scope of the present invention.

MODES FOR CARRYING OUT THE INVENTION

A. Overview

Figure 1:
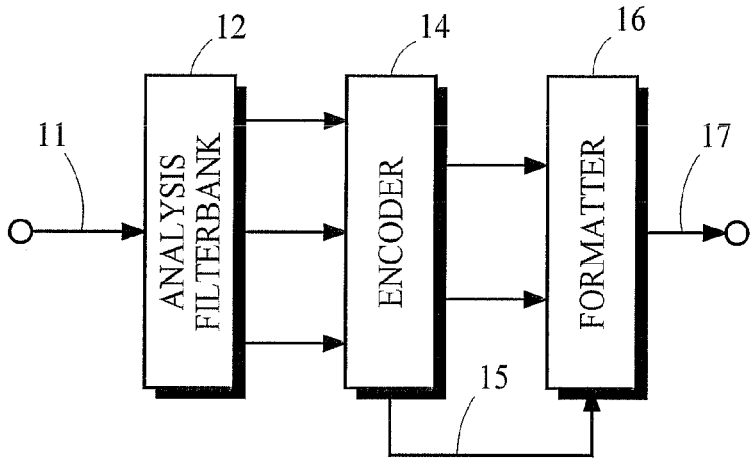
FIG. 1 is a schematic block diagram of a transmitter in an audio coding system.
Figure 2:
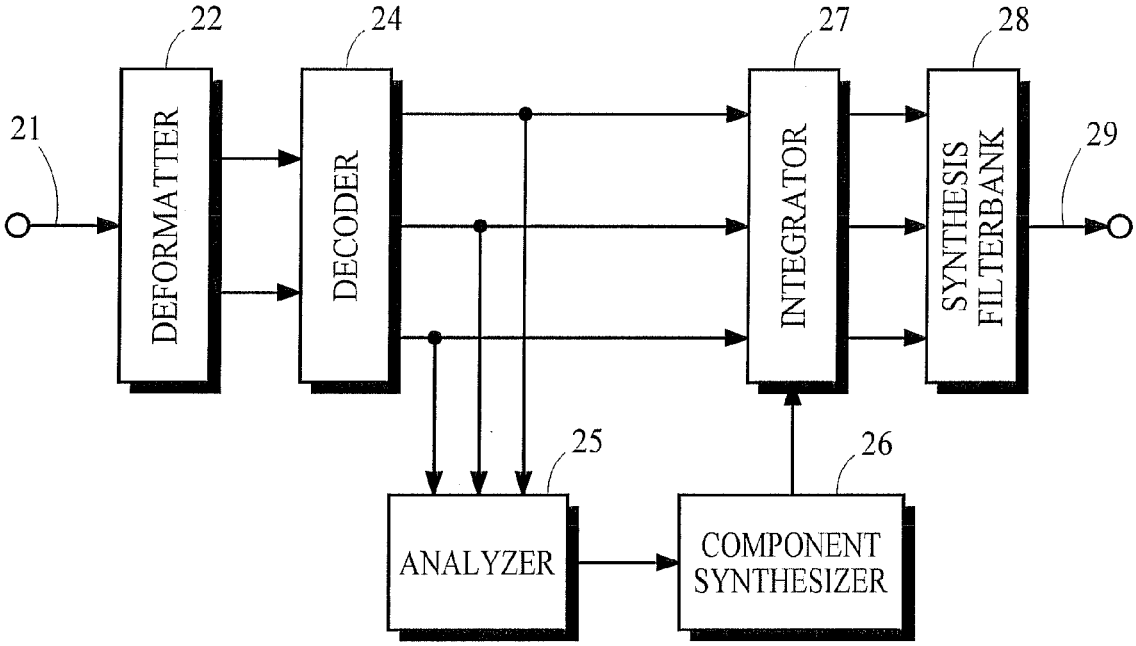
FIG. 2 is a schematic block diagram of a receiver in an audio coding system.

Various aspects of the present invention may be incorporated into a variety of signal processing methods and devices including devices like those illustrated in FIGS. 1 and 2. Some aspects may be carried out by processing performed in only a receiver. Other aspects require cooperative processing performed in both a receiver and a transmitter. A description of processes that may be used to carry out these various aspects of the present invention is provided below following an overview of typical devices that may be used to perform these processes.

FIG. 1 illustrates one implementation of a split-band audio transmitter in which the analysis filterbank 12 receives from the path 11 audio information representing an audio signal and, in response, provides frequency subband signals that represent spectral content of the audio signal. Each subband signal is passed to the encoder 14, which generates an encoded representation of the subband signals and passes the encoded representation to the formatter 16. The formatter 16 assembles the encoded representation into an output signal suitable for transmission or storage, and passes the output signal along the path 17.

FIG. 2 illustrates one implementation of a split-band audio receiver in which the deformatter 22 receives from the path 21 an input signal conveying an encoded representation of frequency subband signals representing spectral content of an audio signal. The deformatter 22 obtains the encoded representation from the input signal and passes it to the decoder 24. The decoder 24 decodes the encoded representation into frequency subband signals. The analyzer 25 examines the subband signals to obtain one or more characteristics of the audio signal that the subband signals represent. An indication of the characteristics is passed to the component synthesizer 26, which generates synthesized spectral components using a process that adapts in response to the characteristics. The integrator 27 generates a set of modified subband signals by integrating the subband signals provided by the decoder 24 with the synthesized spectral components generated by the component synthesizer 26. In response to the set of modified subband signals, the synthesis filterbank 28 generates along the path 29 audio information representing an audio signal. In the particular implementation shown in the figure, neither the analyzer 25 nor the component synthesizer 26 adapt processing in response to any control information obtained from the input signal by the deformatter 22. In other implementations, the analyzer 25 and/or the component synthesizer 26 can be responsive to control information obtained from the input signal.

The devices illustrated in FIGS. 1 and 2 show filterbanks for three frequency subbands. Many more subbands are used in a typical implementation but only three are shown for illustrative clarity. No particular number is important to the present invention.

The analysis and synthesis filterbanks may be implemented by essentially any block transform including a Discrete Fourier Transform or a Discrete Cosine Transform (DCT). In one audio coding system having a transmitter and a receiver like those discussed above, the analysis filterbank 12 and the synthesis filterbank 28 are implemented by modified DCT known as Time-Domain Aliasing Cancellation (TDAC) transforms, which are described in Princen et al., "Subband/Transform Coding Using Filter Bank Designs Based on Time Domain Aliasing Cancellation," ICASSP 1987 Conf. Proc., May 1987, pp. 2161-64.

Analysis filterbanks that are implemented by block transforms convert a block or interval of an input signal into a set of transform coefficients that represent the spectral content of that interval of signal. A group of one or more adjacent transform coefficients represents the spectral content within a particular frequency subband having a bandwidth commensurate with the number of coefficients in the group. The term "subband signal" refers to groups of one or more adjacent transform coefficients and the term "spectral components" refers to the transform coefficients.

The terms "encoder" and "encoding" used in this disclosure refer to information processing devices and methods that may be used to represent an audio signal with encoded information having lower information capacity requirements than the audio signal itself. The terms "decoder" and "decoding" refer to information processing devices and methods that may be used to recover an audio signal from the encoded representation. Two examples that pertain to reduced information capacity requirements are the coding needed to process bit streams compatible with the Dolby Digital and the AAC coding standards mentioned above. No particular type of encoding or decoding is important to the present invention.

B. Receiver

Various aspects of the present invention may be carried out in a receiver that do not require any special processing or information from a transmitter. These aspects are described first.

1. Analysis of Signal Characteristics

The present invention may be used in coding systems that represent audio signals with very low bit rate encoded signals.

The encoded information in very low bit rate systems typically conveys subband signals that represent only a portion of the spectral components of the audio signal. The analyzer 25 examines these subband signals to obtain one or more characteristics of the portion of the audio signal that is represented by the subband signals. Representations of the one or more characteristics are passed to the component synthesizer 26 and are used to adapt the generation of synthesized spectral components. Several examples of characteristics that may be used are described below.

a) Amplitude

The encoded information generated by many coding systems represents spectral components that have been quantized to some desired bit length or quantizing resolution. Small spectral components having magnitudes less than the level represented by the least-significant bit (LSB) of the quantized components can be omitted from the encoded information or, alternatively, represented in some form that indicates the quantized value is zero or deemed to be zero. The level corresponding to the LSB of the quantized spectral components that are conveyed by the encoded information can be considered an upper bound on the magnitude of the small spectral components that are omitted from the encoded information.

The component synthesizer 26 can use this level to limit the amplitude of any component that is synthesized to replace a missing spectral component.

b) Spectral Shape

The spectral shape of the subband signals conveyed by the encoded information is immediately available from the subband signals themselves; however, other information about spectral shape can be derived by applying a filter to the subband signals in the frequency domain. The filter may be a prediction filter, a low-pass filter, or essentially any other type of filter that may be desired.

An indication of the spectral shape or the filter output is passed to the component synthesizer 26 as appropriate. If necessary, an indication of which filter is used should also be passed.

c) Masking

A perceptual model may be applied to estimate the psychoacoustic masking effects of the spectral components in the subband signals. Because these masking effects vary by frequency, the masking provided by a first spectral component at one frequency will not necessarily provide the same level of masking as that provided by a second spectral component at another frequency even though the first and second spectral component have the same amplitude.

An indication of estimated masking effects is passed to the component synthesizer 26, which controls the synthesis of spectral components so that the estimated masking effects of the synthesized components have a desired relationship with the estimated masking effects of the spectral components in the subband signals.

d) Tonality

The tonality of the subband signals can be assessed in a variety of ways including the calculation of a Spectral Flatness Measure, which is a normalized quotient of the arithmetic mean of subband signal samples divided by the geometric mean of the subband signal samples. Tonality can also be assessed by analyzing the arrangement or distribution of spectral components within the subband signals. For example, a subband signal may be deemed to be more tonal rather than more like noise if a few large spectral components are separated by long intervals of much smaller components. Yet another way applies a prediction filter to the subband signals to determine the prediction gain. A large prediction gain tends to indicate a signal is more tonal.

An indication of tonality is passed to the component synthesizer 26, which controls synthesis so that the synthesized spectral component have an appropriate level of tonality. This may be done by forming a weighted combination of tone-like and noise-like synthesized components to achieve the desired level of tonality.

e) Temporal Shape

The temporal shape of a signal represented by subband signals can be estimated directly from the subband signals. The technical basis for one implementation of a temporal-shape estimator may be explained in terms of a linear system represented by equation 1.

$$y(t)=h(t)\cdot x(t) \tag{1}$$

where y(t)=a signal having a temporal shape to be estimated;

h(t)=the temporal shape of the signal y(t);

the dot symbol (·) denotes multiplication; and x(t)=a temporally-flat version of the signal y(t).

This equation may be rewritten as:

$$Y[k]=H[k]*X[k] \tag{2}$$

where

Y[k]=a frequency-domain representation of the signal y(t);

H[k]=a frequency-domain representation of h(t);

the star symbol (*) denotes convolution; and

X[k]=a frequency-domain representation of the signal x(t).

The frequency-domain representation Y[k] corresponds to one or more of the subband signals obtained by the decoder 24. The analyzer 25 can obtain an estimate of the frequency-domain representation H[k] of the temporal shape h(t) by solving a set of equations derived from an autoregressive moving average (ARMA) model of Y[k] and X[k]. Additional information about the use of ARMA models may be obtained from Proakis and Manolakis, "Digital Signal Processing: Principles, Algorithms and Applications," MacMillan Publishing Co., New York, 1988. See especially pp. 818-821.

The frequency-domain representation Y[k] is arranged in blocks of transform coefficients. Each block of transform coefficients expresses a short-time spectrum of the signal y(t). The frequency-domain representation X[k] is also arranged in blocks. Each block of coefficients in the frequency-domain representation X[k] represents a block of samples for the temporally-flat signal x(t) that is assumed to be wide sense stationary. It is also assumed the coefficients in each block of the X[k] representation are independently distributed. Given these assumptions, the signals can be expressed by an ARMA model as follows:

$$Y[k]+\sum_{l=1}^{L} a_l Y[k-l]=\sum_{q=0}^{Q} b_q X[k-q] \tag{3}$$

where

L=length of the autoregressive portion of the ARMA model; and

Q=the length of the moving average portion of the ARMA model.

Equation 3 can be solved for al and bq by solving for the autocorrelation of Y[k]:

$$E\{Y[k]\cdot Y[k-m]\} = -\sum_{l=1}^{L} a_l E\{Y[k-l]\cdot Y[k-m]\} + \sum_{q=0}^{Q} b_q E\{X[k-q]\cdot Y[k-m]\} \quad (4)$$

where

E { } denotes the expected value function.

Equation 4 can be rewritten as:

$$R_{YY}[m] = -\sum_{l=1}^{L} a_l R_{YY}[m-l] + \sum_{q=0}^{Q} b_q R_{YY}[m-q] \quad (5)$$

where

RYY[n] denotes the autocorrelation of Y[n]; and

RXY[k] denotes the cross-correlation of Y[k] and X[k].

If we further assume the linear system represented by H[k] is only autoregressive, then the second term on the right side of equation 5 can be ignored. Equation 5 can then be rewritten as:

$$R_{YY}[m] = -\sum_{i=1}^{L} a_l R_{YY}[m-l] \quad (6)$$

for $m > 0$ which represents a set of L linear equations that can be solved to obtain the L coefficients ai.

With this explanation, it is now possible to describe one implementation of a temporal-shape estimator that uses frequency-domain techniques. In this implementation, the temporal-shape estimator receives the frequency-domain representation Y[k] of one or more subband signals y(t) and calculates the autocorrelation sequence RYY[m] for $-L \leqq m \leqq L$. These values are used to establish a set of linear equations that are solved to obtain the coefficients ai, which represent the poles of a linear all-pole filter FR shown below in equation 7.

$$FR(z) = \frac{1}{1 + \sum_{i=1}^{L} a_i z^{-i}} \quad (7)$$

This filter can be applied to the frequency-domain representation of an arbitrary temporally-flat signal such as a noise-like signal to obtain a frequency-domain representation of a version of that temporally-flat signal having a temporal shape substantially equal to the temporal shape of the signal y(t).

A description of the poles of filter FR may be passed to the component synthesizer 26, which can use the filter to generate synthesized spectral components representing a signal having the desired temporal shape.

2. Generation of Synthesized Components

The component synthesizer 26 may generate the synthesized spectral components in a variety of ways. Two ways are described below. Multiple ways may be used. For example, different ways may be selected in response to characteristics derived from the subband signals or as a function of frequency.

A first way generates a noise-like signal. For example, essentially any of a wide variety of time-domain and frequency-domain techniques may be used to generate noise-like signals.

A second way uses a frequency-domain technique called spectral translation or spectral replication that copies spectral components from one or more frequency subbands. Lower-frequency spectral components are usually copied to higher frequencies because higher frequency components are often related in some manner to lower frequency components. In principle, however, spectral components may be copied to higher or lower frequencies. If desired, noise may be added or blended with the translated components and the amplitude may be modified as desired. Preferably, adjustments are made as necessary to eliminate or at least reduce discontinuities in the phase of the synthesized components.

The synthesis of spectral components is controlled by information received from the analyzer 25 so that the synthesized components have one or more characteristics obtained from the subband signals.

3. Integration of Signal Components

The synthesized spectral components may be integrated with the subband signal spectral components in a variety of ways. One way uses the synthesized components as a form of dither by combining respective synthesized and subband components representing corresponding frequencies. Another way substitutes one or more synthesized components for selected spectral components that are present in the subband signals. Yet another way merges synthesized components with components of the subband signals to represent spectral components that are not present in the subband signals. These and other ways may be used in various combinations.

C. Transmitter

Aspects of the present invention described above can be carried out in a receiver without requiring the transmitter to provide any control information beyond what is needed by a receiver to receive and decode the subband signals without features of the present invention. These aspects of the present invention can be enhanced if additional control information is provided. One example is discussed below.

The degree to which temporal shaping is applied to the synthesized components can be adapted by control information provided in the encoded information. One way this can be done is through the use of a parameter β as shown in the following equation.

$$FR(z) = \frac{1}{1 + \sum_{i=1}^{L} a_i \beta^i z^{-i}} \quad (8)$$

for $0 \leq \beta \leq 1$

The filter provides no temporal shaping when $\beta=0$. When $\beta=1$, the filter provides a degree of temporal shaping such that correlation between the temporal shape of the synthesized components and the temporal shape of the subband signals is maximum. Other values for $\beta$ provide intermediate levels of temporal shaping.

In one implementation, the transmitter provides control information that allows the receiver to set $\beta$ to one of eight values.

The transmitter may provide other control information that the receiver can use to adapt the component synthesis process in any way that may be desired.

D. Implementation

Figure 3:
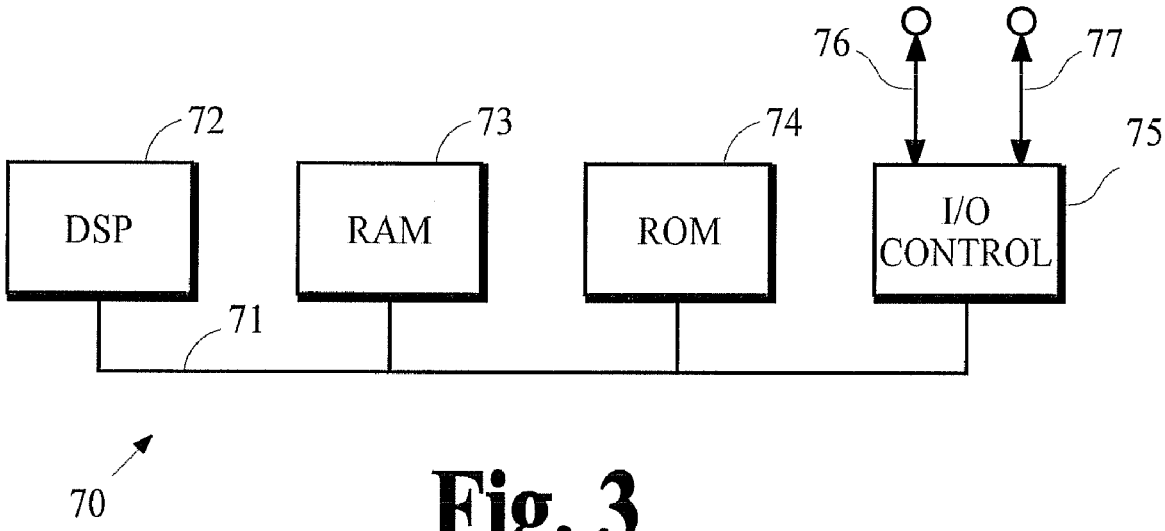
FIG. 3 is a schematic block diagram of an apparatus that may be used to implement various aspects of the present invention.

Various aspects of the present invention may be implemented in a wide variety of ways including software in a general-purpose computer system or in some other apparatus that includes more specialized components such as digital signal processor (DSP) circuitry coupled to components similar to those found in a general-purpose computer system. FIG. 3 is a block diagram of device 70 that may be used to implement various aspects of the present invention in transmitter or receiver. DSP 72 provides computing resources. RAM 73 is system random access memory (RAM) used by DSP 72 for signal processing. ROM 74 represents some form of persistent storage such as read only memory (ROM) for storing programs needed to operate device 70 and to carry out various aspects of the present invention. I/O control 75 represents interface circuitry to receive and transmit signals by way of communication channels 76, 77. Analog-to-digital converters and digital-to-analog converters may be included in I/O control 75 as desired to receive and/or transmit analog audio signals. In the embodiment shown, all major system components connect to bus 71, which may represent more than one physical bus; however, a bus architecture is not required to implement the present invention.

In embodiments implemented in a general purpose computer system, additional components may be included for interfacing to devices such as a keyboard or mouse and a display, and for controlling a storage device having a storage medium such as magnetic tape or disk, or an optical medium. The storage medium may be used to record programs of instructions for operating systems, utilities and applications, and may include embodiments of programs that implement various aspects of the present invention.

The functions required to practice various aspects of the present invention can be performed by components that are implemented in a wide variety of ways including discrete logic components, one or more ASICs and/or program-controlled processors. The manner in which these components are implemented is not important to the present invention.

Software implementations of the present invention may be conveyed by a variety machine readable media such as baseband or modulated communication paths throughout the spectrum including from supersonic to ultraviolet frequencies, or storage media including those that convey information using essentially any magnetic or optical recording technology including magnetic tape, magnetic disk, and optical disc. Various aspects can also be implemented in various components of computer system 70 by processing circuitry such as ASICs, general-purpose integrated circuits, microprocessors controlled by programs embodied in various forms of ROM or RAM, and other techniques.

The invention claimed is:

1. A method for processing encoded audio information, wherein the method comprises:

receiving the encoded audio information and obtaining therefrom subband signals representing spectral components of an audio signal;

examining some but not all of the subband signals to obtain an indication of temporal shape of the audio signal;

generating synthesized signal components and modifying the synthesized signal components in response to the indication of temporal shape to obtain modified synthesized signal components;

integrating the modified synthesized signal components with the subband signals to obtain a set of modified subband signals; and generating the audio information by applying a synthesis filterbank to the set of modified subband signals.

2. The method of claim 1 that obtains the set of modified subband signals by combining the modified synthesized signal components with respective components of the subband signals.

3. The method of claim 1 that obtains the indication of temporal shape of the audio signal by examining components of one or more subband signals in a first portion of spectrum; and generates the synthesized signal components by copying one or more components of the subband signals in the first portion of spectrum to a second portion of spectrum to form synthesized subband signals and modifying the copied components in response to the indication of temporal shape.

4. An apparatus for processing encoded audio information, wherein the apparatus comprises:

an input terminal that receives the encoded audio information;

memory; and processing circuitry coupled to the input terminal and the memory; wherein the processing circuitry is adapted to:

receive the encoded audio information and obtain therefrom subband signals representing spectral components of an audio signal;

examine some but not all of the subband signals to obtain an indication of temporal shape of the audio signal;

generate synthesized signal components and modify the synthesized signal components in response to the indication of temporal shape to obtain modified synthesized signal components;

integrate the modified synthesized signal components with the subband signals to obtain a set of modified subband signals; and generate the audio information by applying a synthesis filterbank to the set of modified subband signals.

5. The apparatus of claim 4, wherein the processing circuitry is adapted to obtain the set of modified subband signals by combining the modified synthesized signal components with respective components of the subband signals.

6. The apparatus of claim 4, wherein the processing circuitry is adapted to:

obtain the indication of temporal shape of the audio signal by examining components of one or more subband signals in a first portion of spectrum; and generate the synthesized signal components by copying one or more components of the subband signals in the first portion of spectrum to a second portion of spectrum to form synthesized subband signals and modifying the copied components in response to the indication of temporal shape.

7. A non-transitory storage medium that is readable by a device and that records a program of instructions executable by the device to perform a method for processing encoded audio information, wherein the method comprises:

receiving the encoded audio information and obtaining therefrom subband signals representing spectral components of an audio signal;

examining some but not all of the subband signals to obtain an indication of temporal shape of the audio signal;

generating synthesized signal components and modifying the synthesized signal components in response to the indication of temporal shape to obtain modified synthesized signal components;

integrating the modified synthesized signal components with the subband signals to obtain a set of modified subband signals; and generating the audio information by applying a synthesis filterbank to the set of modified subband signals.

8. The storage medium of claim 7, wherein the method obtains the set of modified subband signals by combining the modified synthesized signal components with respective components of the subband signals.

9. The storage medium of claim 7, wherein the method:

obtains the indication of temporal shape of the audio signal by examining components of one or more subband signals in a first portion of spectrum; and generates the synthesized signal components by copying one or more components of the subband signals in the first portion of spectrum to a second portion of spectrum to form synthesized subband signals and modifying the copied components in response to the indication of temporal shape.

* * * * *